US005449114A

United States Patent [19]

Wells et al.

[11] Patent Number: 5,449,114

[45] Date of Patent: Sep. 12, 1995

[54] METHOD AND STRUCTURE FOR OPTIMIZING ATOMIZATION QUALITY OF A LOW PRESSURE FUEL INJECTOR

[75] Inventors: Marvin D. Wells, Redford; Debojit Barua, Troy, both of Mich.; William P. Richardson, Columbus, Ind.; Lawrence W. Evers, Lake Linden, Mich.

[73] Assignee: Ford Motor Company, Dearborn, Mich.

[21] Appl. No.: 293,102

[22] Filed: Aug. 19, 1994

Related U.S. Application Data

[63] Continuation of Ser. No. 102,929, Aug. 6, 1993, abandoned.

[51] Int. Cl.[6] ..... F02M 61/16; F02M 63/00

[52] U.S. Cl. ..... 239/5; 239/552; 239/584; 239/590.3; 239/590.5; 239/596; 239/DIG. 19

[58] Field of Search ..... 239/5, 533.12, 533.13, 239/533.14, 552, 584, 585.1, 590.3, 590.5, 596, 601, DIG. 19

[56] References Cited

U.S. PATENT DOCUMENTS

| | | | |
|---|---|---|---|
| 2,386,918 | 10/1945 | Timpson | 239/590.3 X |
| 3,591,907 | 7/1971 | MacMunn . | |
| 3,831,860 | 8/1974 | Gullaksen et al. . | |
| 4,364,523 | 12/1982 | Parkison et al. . | |
| 4,647,013 | 3/1987 | Giachino et al. . | |
| 4,808,260 | 2/1989 | Sickafus et al. . | |
| 4,828,184 | 5/1989 | Gardner et al. . | |
| 4,907,748 | 3/1990 | Gardner et al. . | |
| 4,925,111 | 5/1990 | Fuertsch et al. | 239/585.1 X |
| 5,128,645 | 7/1992 | Suda . | |
| 5,163,621 | 11/1992 | Kato et al. . | |

FOREIGN PATENT DOCUMENTS

| | | | |
|---|---|---|---|
| 4112150 | 3/1992 | Germany . | |
| 502540 | 11/1954 | Italy . | |
| 667463 | 3/1952 | United Kingdom | 239/533.12 |
| 2046835 | 11/1980 | United Kingdom . | |

*Primary Examiner*—William Grant

*Attorney, Agent, or Firm*—Richard D. Dixon; Roger L. May

[57] ABSTRACT

A method for improving the atomization quality from a fluid injector includes the steps of inducing a first vortex turbulence in the fluid flowing past a first protrusion in a supply orifice having a flow axis therein, guiding the fluid through a turbulence cavity and then out through a first metering orifice having another protrusion positioned downstream from the first protrusion by a distance y measured generally parallel to the flow axis and by a distance x measured generally perpendicular to the flow axis. The droplet size of the fluid exiting from the metering orifice is reduced by sizing the x and y dimensions to position the first vortex turbulence within the turbulence cavity operatively adjacent to and upstream from the first metering orifice. In a preferred embodiment, the ratio of x/y is greater than 0.5 and less than 5. A fuel injector nozzle practicing this process is also provided.

13 Claims, 3 Drawing Sheets

METHOD AND STRUCTURE FOR OPTIMIZING ATOMIZATION QUALITY OF A LOW PRESSURE FUEL INJECTOR

This is a continuation of application Ser. No. 08/102,929 filed Aug. 6, 1993, now abandoned.

BACKGROUND OF THE INVENTION

1. Field of the Invention

This invention relates to nozzles for providing fine atomization of liquids expelled therethrough, and more particularly to nozzles used for atomizing fuel before injection into an internal combustion engine.

2. Prior Art

Stringent emission standards for internal combustion engines suggest the use of advanced fuel metering techniques that provide extremely small fuel droplets. The fine atomization of the fuel not only improves emission quality of the exhaust, but also improves the cold start capabilities, fuel consumption and performance.

Smaller fuel droplets generally are dispersed over a larger area and therefore have greater volumes of surrounding air as required to complete the combustion process. Smaller fuel droplets also promote a more homogeneous mixture of fuel and air, which in turn provides a faster, more complete combustion process. This improved combustion process reduces hydrocarbon (HC) and carbon monoxide (CO) emissions which are generally caused by localized high fuel to air ratios resulting from heterogeneous injector sprays.

Also, under cold start conditions, smaller fuel droplets allow the use of smaller quantities of fuel in the cold start procedure, thereby greatly reducing the HC and CO emissions. If the fuel can be made to vaporize more quickly, the air/fuel mixture favorable for ignition will develop more quickly and the engine will start sooner, thereby reducing the uncombusted and incompletely combusted fuel/air mixture.

As an example of micromachined devices that are used for atomizing liquids, U.S. Pat. No. 4,828,184 discloses the use of silicon plates having openings for metering the fuel flow. A first opening in a first silicon plate is offset from a second opening in a second silicon plate juxtaposed with the first silicon plate. The area between the first and second openings has a reduced thickness so as to form a shear gap for accelerating the flow of the fuel through opposing shear gaps in a direction substantially parallel to plane of the first and second plates. Such shear flow causes turbulence and fluid dispersion advantages for atomizing the fuel before it is propelled into the combustion chamber of an internal combustion engine.

SUMMARY OF THE INVENTION

A method for improving the atomization quality from a fluid injector, includes the steps of inducing a first turbulence in the fluid flowing past a first protrusion in a supply orifice having a flow axis therein, guiding the fluid through a turbulence cavity and then out through a first metering orifice having another protrusion positioned downstream from the first protrusion by a distance y measured generally parallel to the flow axis and by a distance x measured generally perpendicular to the flow axis, and minimizing the droplet size of the fluid exiting from the metering orifice by maintaining the x/y ratio greater than 0.5. A second turbulence may be induced in the fluid adjacent the metering orifice for enhancing the atomization of the fluid.

A fuel injector nozzle practicing this process includes a supply plate having an input orifice that includes a first turbulence generator adjacent a downstream section of the supply orifice. A metering plate is provided downstream from the supply plate and includes at least one metering orifice for regulating the flow of the atomized fuel therethrough. The metering plate also includes a second turbulence generator adjacent an upstream section for interacting with the turbulent fuel downstream of the first turbulence generator. The mean diameter of the atomized fuel is minimized when the lateral offset of the turbulence generators in the supply orifice and the metering orifice is at least greater than half the vertical offset between the two turbulence generators.

A nozzle in accordance with the present invention may be fabricated using silicon micromachine, selective metal etching, or conventional metal machining techniques and produces a fluid flow of high velocity, and relatively small diameter fuel droplets.

It is therefore a primary object of the present invention to define a structure and process that will introduce turbulent flow at the optimum location in an atomizing nozzle so as to minimize the size of atomized droplets of liquid.

BRIEF DESCRIPTION OF THE DRAWINGS

Other objects, features and advantages of the present invention will be apparent from studying the written description and the drawings in which.

BACKGROUND TECHNICAL DISCUSSION

Figure 1:
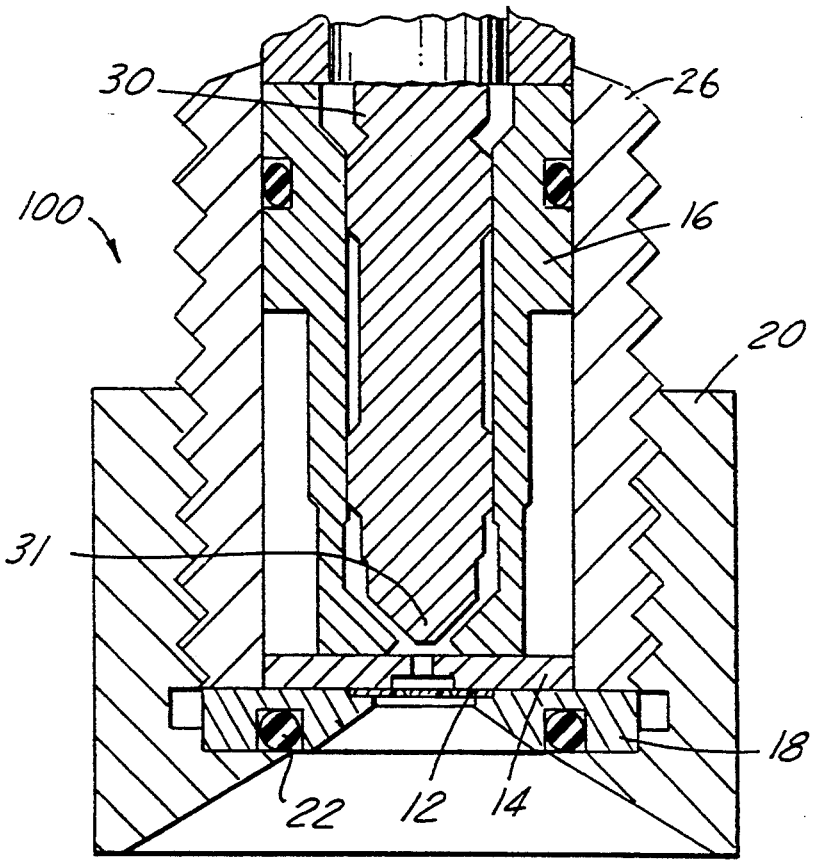
FIG. 1 illustrates a simplified frontal cross-section view of an automotive fuel injector of the type that may be used in conjunction with the present invention.

It is well known that supplying energy to a fluid may improve the atomization of liquid jets flowing from an exhaust orifice. Energy may be added by several well known means, including ultrasonic, heat, pumped air, laser, etc. In contrast to these prior art teachings, the present invention introduces energy into the liquid through the development of turbulent eddies upstream of the orifice plate in the tip of the fuel injector.

A turbulent flow condition in a fluid flowing through a confined area can be created in three possible ways. First, the rapid fluid flow past a solid wall can lead to unstable, self-amplifying velocity fluctuations. These fluctuations form near the wall and then spread into the remainder of the internal fluid flow or stream. Second, velocity gradients between a fast moving fluid stream and a slow moving fluid stream can produce turbulent eddies. Third, fluid flow past a solid body or sharp angularity in the internal flow causes eddies to set-up in the wake of the body. This is the primary mechanism which will be implemented in the present invention.

In such cases turbulent flow arises from some instability which is present in laminar flows at high Reynolds Numbers. The transition to turbulence is usually initiated by an instability which is two dimensional in simple cases. These two dimensional instabilities produce secondary motions, not parallel to the mean fluid flow, which are three dimensional and also unstable. These three dimensional instabilities are formed locally and when several local three dimensional instabilities interact, a large turbulent field is produced.

Fluids flowing past a solid object that produces turbulence can be described with regard to-several common characteristics. Turbulent flows are very random and irregular. Turbulent flows exhibit diffusivity of turbulence which promotes mixing, and increases momentum, heat and mass transfer rates. A flow is not turbulent unless velocity fluctuations are present throughout the field. Turbulent flows usually originate due to some instability in laminar flow, but turbulent flows are always created at high Reynolds Numbers. Turbulence is both three dimensional and rotational, therefore creating vortices. Vortex stretching is the phenomenon which causes turbulence to be three dimensional. Without vortex stretching, there would be no fluctuation of the eddies and the eddies would therefore be two dimensional and non-turbulent.

Kinetic energy of the turbulent flow dissipates into internal energy contained in the fluid due to the viscous shear stresses on the fluid. For this reason, turbulence cannot sustain itself and needs a continual supply of external energy to maintain structure. Large eddies are located in the center of the flow. These large eddies turn into small eddies as the wall is approached, and kinetic energy of the smaller eddies is dissipated into thermal energy at the wall. Turbulent flow is a continuum, wherein no section of the turbulent flow can be readily distinguished from its neighboring section.

When fluid flows in a pipe under turbulent conditions, smaller eddies form near the wall due to strong velocity gradients tearing the fluid. Vortex shedding at angularities (sharp corners) can induce strong eddie currents at Reynolds Numbers as low as 300–400. The sharpness of these angularities is very important, since eddies are shed much more readily from sharp corners then from smooth ones. Sharp corners having included angles of approximately 90 degrees or less are preferred.

The present invention will utilize these physical phenomenon relating to turbulence generators in order to induce additional energy into fluid flowing past a protruding object. The energy introduced in the fluid will be isolated and then utilized in order to promote the fine atomization of the fluid as it is metered and then ejected from an orifice.

DESCRIPTION OF THE PREFERRED EMBODIMENT

A simplified fuel injector element is illustrated in FIG. 1 and designated by the reference numeral 100. The fuel injector includes a nozzle element that comprises an orifice plate or metering plate 12 attached to a turbulence generator 14, both of which are compressed between the injector body 16 and a flow element tip washer 18. In turn, these elements are compressed between a flow element tip 20 and a injector body 16. A circumferential washer 22 seals the flow element tip washer 18 to the flow tip 20, and the injector body 16 is restrained within the flow element 26. The injector illustrated in FIG. 1 is a test fixture utilized to simulate an actual nozzle and fluid flow therefrom. While the illustrated test fixture was used in the development Of the present invention and the data presented herein, other fuel injector designs may be used in production embodiments. For example, the test fixture form of the fuel injector element 30 is illustrated as having a truncated distended end 31, which may or may not be used in a production embodiment.

Figure 2:
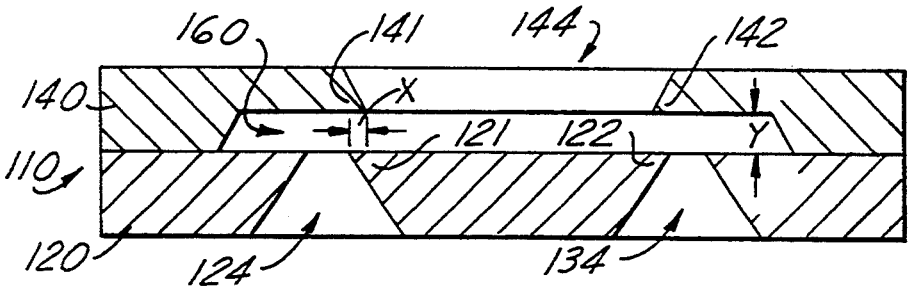
FIG. 2 illustrates a frontal sectioned view of a first preferred embodiment of the injector nozzle in accordance with the present invention.
Figure 2A:
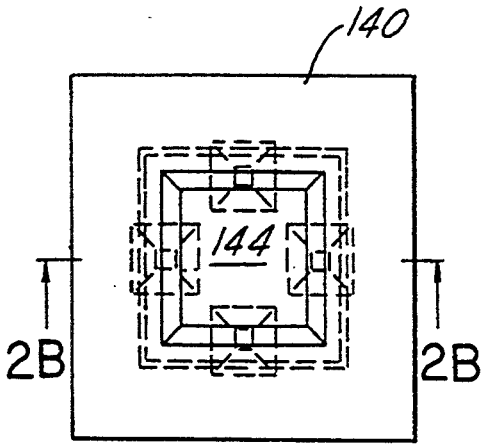
FIGS. 2*a*, 2*b* and 2*c* illustrate the top, frontal sectioned, and bottom views of the nozzle of FIG. 2.
Figure 2B:
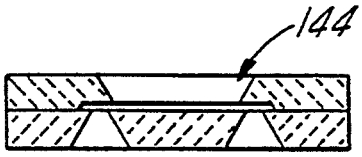
Figure 2C:
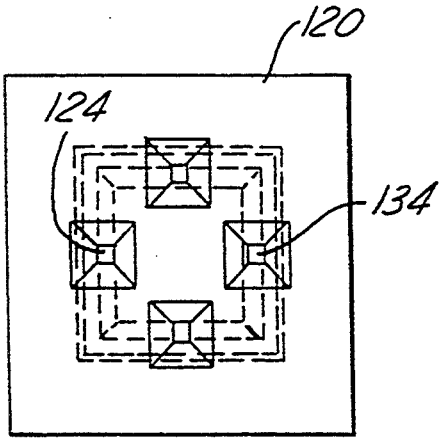

As illustrated in FIG. 2, a first preferred embodiment the nozzle element 110 comprises a turbulence generator plate 140 and an exhaust orifice plate or metering plate 120. The compound silicon micromachined orifice plates can be manufactured from silicon wafers using well known semiconductor processing techniques, with one plate being bonded to the top of the other. The top silicon orifice plate mimics the turbulence generator 14 and the bottom silicon orifice plate mimics the metering plate 12. FIG. 2*a* illustrates a top view and FIG. 2*c* illustrates a bottom view of the nozzle shown in FIG. 2 and 2*b*. Even though the supply and metering orifices illustrated in FIGS. 2*a*, 2*b* and 2*c* are shown as being rectangular, they may also have other shapes without departing from the basic teachings of the present invention.

While the preferred embodiment of the present invention has been illustrated as being constructed from silicon wafers, the invention may also be constructed of various metal plates, including stainless steel and various laminate materials having differential etch rates (e.g. copper-nickel, nickel-stainless), without departing from the teachings of the invention. However, the silicon construction is preferred because of the processing capability to maintain 10 micron alignment accuracy and to achieve sharp acute angles at the edges of the operative orifices.

Figure 3:
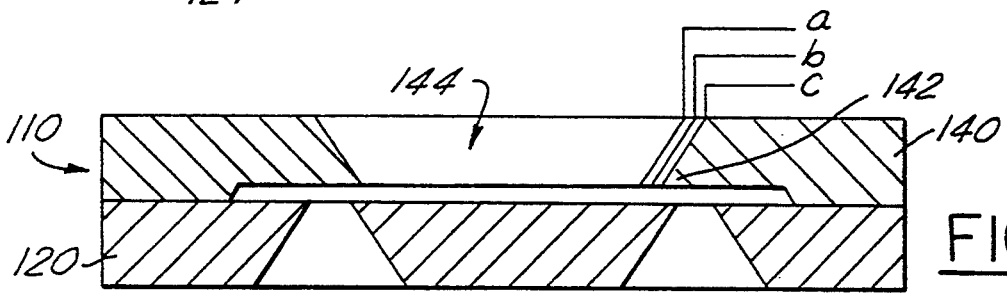
FIG. 3 illustrates an alternate embodiment having a different height for the turbulent cavity in the nozzle in accordance with the present invention.

FIG. 3 illustrates another preferred embodiment of the compound orifice plate having different x and y dimensions as compared with the plate illustrated in FIG. 2. In FIG. 3 the position of the corner turbulence generator 142 is moved between positions a, b and c to illustrate the x variable adjustment in accordance with the present invention. The importance of the x and y dimensions for each of the elements in the plate will be discussed subsequently.

With reference to FIG. 2, turbulent eddies may be formed in a turbulence cavity 160 defined between the metering plate 120 and the turbulence generator plate 140 due to the acute edges 141 and 142 on the turbulence generator plate 140. These eddies greatly aid in the breaking up of the liquid into droplets. With additional reference to FIG. 5, the location of the eddies is critical in the atomization process of the liquid. If the eddie E1 can be forced to reside directly above the metering orifice 124 in the metering plate 120, the atomization should be greatly enhanced. As the size of the turbulence generator orifice 144 increases, the edge 141 of the orifice will approach the edge of the metering orifice 124 (or 134) in the metering plate 120.

Figure 5:
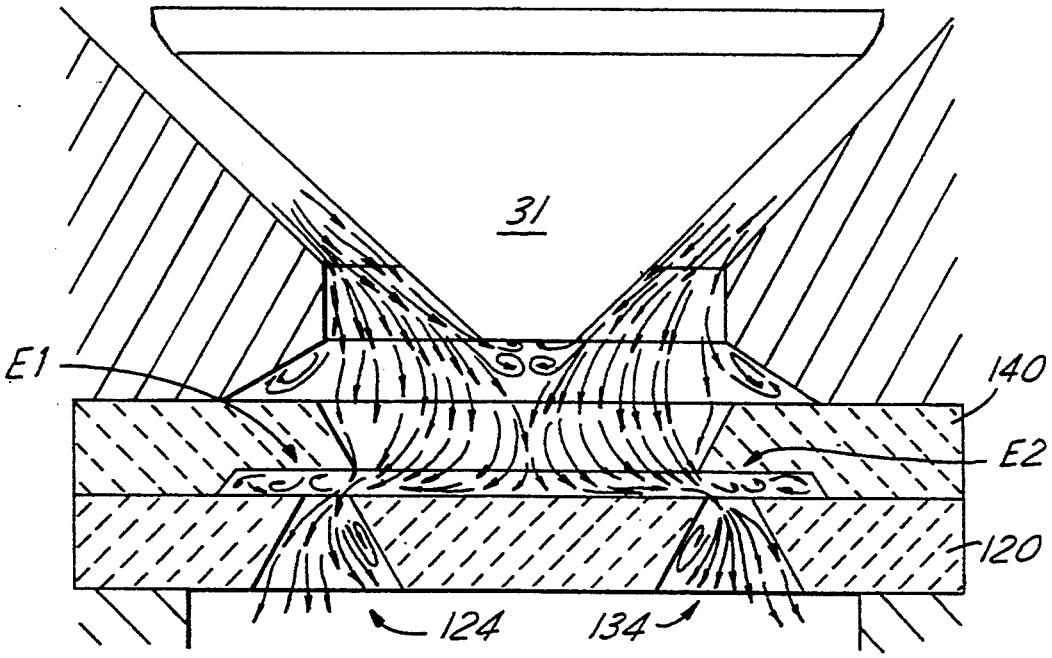
FIG. 5 illustrates a simplified hypothetical representation of possible fluid flow lines showing turbulence and eddies within the fuel injector and nozzle in accordance with the present invention.

As illustrated in FIG. 3, as the effective diameter of the turbulence generator orifice 144 increases from positions a to b to c, the edge 142 of the orifice 144 approaches the center of the exhaust orifice 134 in the metering plate 120. In this manner the eddie E2 as illustrated in FIG. 5 is moved outwardly from the supply orifice 144. At some point the eddie E2 is no longer above the metering orifice 134 in the lower metering plate 120. It is this relationship between the two orifices 144 and 134 (or 144 and 124) and the location of the resultant eddies E1 and E2 that determines the SMD of the spray droplets.

The creation of turbulence in the turbulence cavity 160 upstream of the metering plate 120 results in a dramatic improvement, that is a significant reduction, in the SMD of the spray emitted from the exhaust or metering orifices 124 and 134. A high Reynolds Number is not necessary to achieve good atomization. However, the flow must not be overly restricted, thereby creating a very low Reynolds Number, since the restricted flow does not result in a lower SNID.

Of the turbulence generators tested, the. single orifice generators were the most effective because they did not restrict the flow of fluid as much as a multiple orifice generator at the same flow rate capability. This geometry results in a higher fluid velocity and more energy contained in the eddies. The location of the eddies, as previously discussed, is critical in that if the eddies are placed outside of the metering orifices in the lower plate, the SMD of the atomized fluid droplets tends to increase.

With reference to FIGS. 2 and 3, the dimension x is defined as the horizontal distance between the acute angled edge 141 (or 142) of the supply orifice 144 in the upper plate 140 and the acute angle edge 121 (or 122) of the corresponding exhaust or metering orifice 124 (or 134) in the lower metering plate 120. While both edges are illustrated with the preferred acute angle, the principles of the present invention also work well with edges up to and including an included angle of approximately 90 degrees, as long as the edge is designed to create an effective eddy within the downstream section of the flow.

Figure 4:
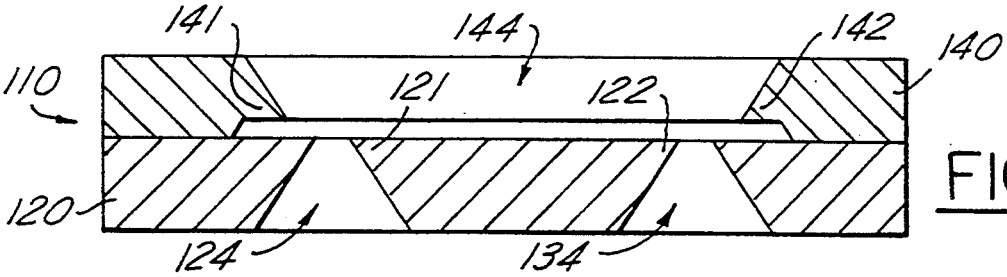
FIG. 4 illustrates an alternate, non-preferred embodiment of the nozzle in accordance with the present invention.

The y dimension is defined as the gap height of the turbulence cavity 160 defined between the upper orifice plate 140 and the lower metering plate 120. When the edge 141 of the upper orifice 144 lines up directly with the edge 121 of the exhaust orifice 124 in the metering plate 120, the x/y ratio will equal zero. As the supply orifice 144 in the upper plate 140 is reduced in size, the edge 141 moves inwardly, and the x/y ratio becomes more positive. As the supply orifice 144 in the upper plate 140 becomes larger, the outer edge 141 moves outwardly (away from a central axis of the injector), and after the x dimension passes below zero the x/y ratio becomes negative. FIG. 4 illustrates the position of the edges 121 and 141 in a non-preferred embodiment of a nozzle having a negative x/y ratio.

Figure 6:
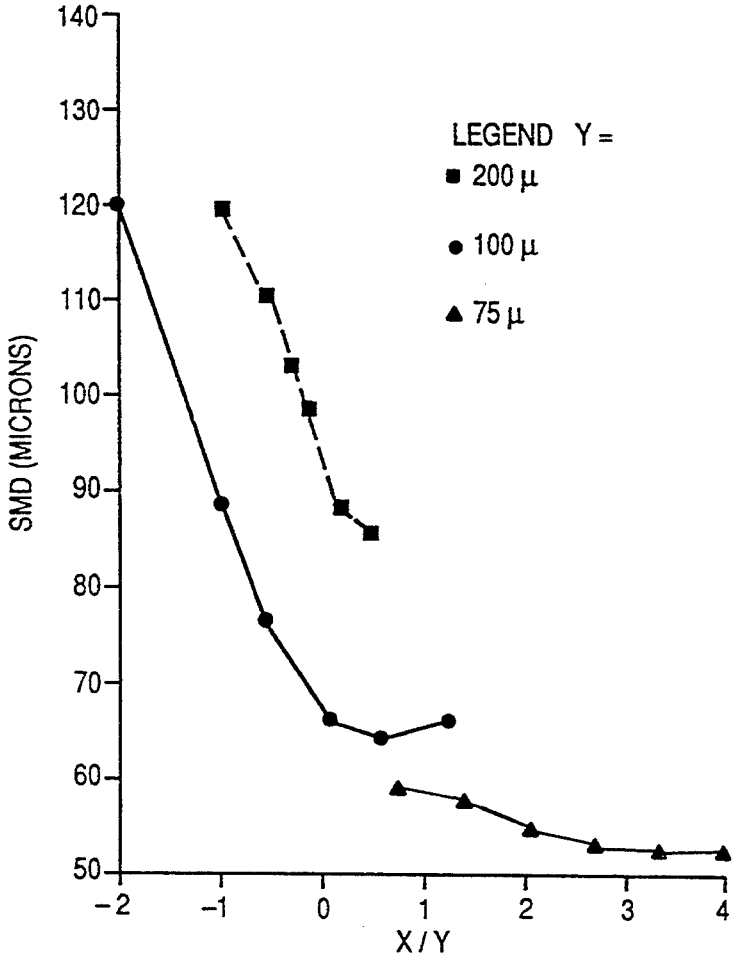
FIG. 6 is a graphical representation of the Sauter Mean Diameter (SMD) of the injector spray fuel droplets as a function of the x–y variables. The x value is a variable which is varied from −200 to +300 μm for each of the three different y values.

Given this definition of the x/y ratio, measurements can be taken along the center line of the supply orifice 144, approximately three inches downstream from the injector tip. With the fuel pressure remaining constant at 40 psi, and with a constant Stoddard fluid temperature of 70° F., the plot of FIG. 6 illustrates the Sauter Mean Diameter (SMD) of the injector spray as a function of the x/y ratio. As can be seen, as the x/y ratio increases from −2 toward 0.5, the resulting SMD of the spray decreases. The SMD decreases dramatically up to an x/y ratio value of 0.5, and then no significant improvement is apparent for x/y ratios beyond 0.5. Therefore, in order to create the optimum or smallest atomization for given aperture sizes, the relative separation distance between the supply orifice 144 in the upper plate 144 and the exhaust orifice 124 (and 134) in the lower metering plate 120 should be at least one-half the gap height.

This result is predicted from the hypothetical discussion of the location of the eddies as previously discussed. At x/y equals 0.5, the eddies E1 and E2 which were created by the sharp corners 141 and 142 in the upper orifice 144 are located in the optimal position above the metering orifices 124 and 134 in the lower metering plate 120 as illustrated more clearly in FIG. 5. This results in the lower SMD of the spray shown in FIG. 6. As the sharp corner 141 of the upper orifice 144 is moved outside of the metering orifice 124 in the lower plate 120, that is in a negative y direction, the eddie E1 becomes less effective and the atomization size of the resulting droplets increases. As a result of experimentation, the optimum orifice plate geometry was produced with an SMD of 53 microns, a flow rate of 6.37 liters per hour, producing a cone angle of 41° with an x/y ratio of 4.0. This SMD of 53 microns is approximately 62% smaller than the SMD produced by a base line SMM injector (approximately 140 microns).

Another visible trend in FIG. 6 is that of the gap height y in relation to the SMD of the spray. As the gap height y decreases, the SMD decreases for a given value of the x/y ratio. If this result is extrapolated, then the smaller the gap height y becomes, the smaller the SMD of spray will become. This may be explained in one of several ways. First, the exhaust droplets may become smaller because they are being forced through a smaller opening, thus creating shear forces on a larger surface area of the fluid. Another explanation may be that the eddies which are formed by the sharp corners of the supply orifice are being moved closer to the exhaust orifices in the metering plate, causing more random motion immediately above the metering orifices. This would put more energy into the fluid immediately above the exhaust orifices, which in turn provides a better atomization of the liquid.

In general terms, it may be concluded that as the x/y ratio increases, the flow rate generally decreases. As the x/y ratio increases, an increased restriction to the flow of the fluid results. When the x/y ratio is highly negative, the supply orifice in the upper plate completely exposes the exhaust orifices in the lower metering plate, thus causing no restriction to the fluid flow. As the x/y ratio increases further, the supply orifice size is reduced for a constant gap height, and the exhaust orifices in the metering plate begin to be covered up so that the fluid must turn a sharp corner as it exits the metering orifices in the lower plate. Therefore, as the x/y ratio increases, the flow rate decreases.

Figure 7:
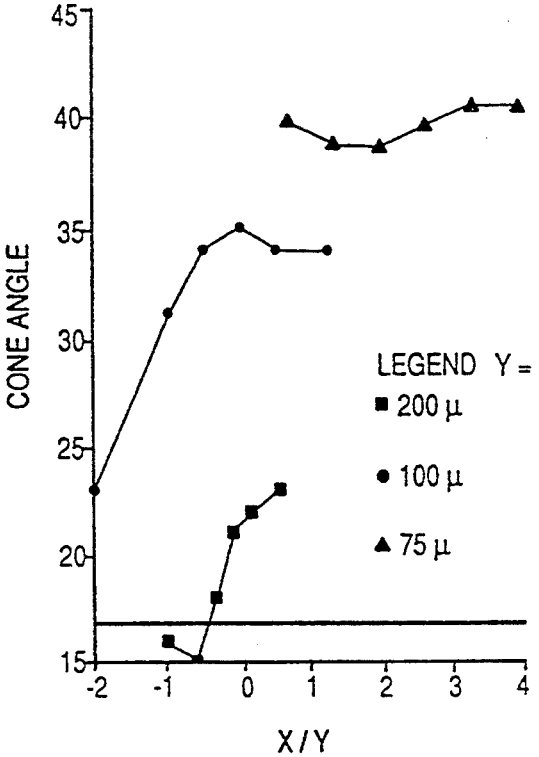
FIGS. 7 is a graphical representation of the cone angle of the injector spray fuel droplets as a function of the x–y variables. The x value is a variable which is varied from −200 to +300 μm for each of the three different y values.

FIG. 7 is a plot of the cone angle, which is defined aS the angle of the spray with respect to the axis of the supply orifice, for the injector spray versus the x/y ratio. The trends are similar for all of the curves for the selected test geometry. As the x/y ratio increases, the cone angle of the spray from the metering orifice also increases. This can be explained by the fluid turning the sharp corner of the supply orifice in the upper plate. When the x/y ratio is highly negative, the exhaust orifices in the metering plate are completely exposed to fluid and the fluid may flow directly through the metering orifices. All of the motion then is in the vertical direction through both orifices. However, as the x/y ratio becomes more positive and the flow is restricted, the fluid must turn the corner in the supply orifice, thus producing fluid momentum in the horizontal direction. It is this horizontal momentum that creates the enlarged cone angle. As with the droplet size curve shown in FIG. 6, the cone angle appears to reach a maximum at an x/y ratio approximating 0.5, and remains relatively constant as the x/y ratio increases beyond this value.

Figure 8:
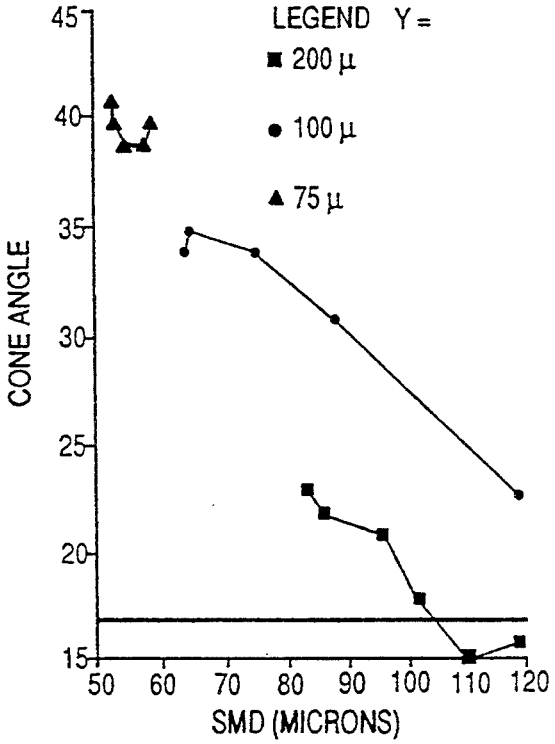
FIGS. 8 is a graphical representation of the cone angle of the injector spray fuel droplets as a function of the x–y variables. The x value is a variable which is varied from −200 to +300 μm for each of the three different y values.

With continuing reference to FIG. 7, it is apparent that the cone angle changes as a function of the height y of the turbulence cavity. However, the cone angle does change as a function of the gap height y. FIG. 8 is a plot of cone angle of the injector spray versus the SMD of the spray. It is apparent that as the cone angle is reduced, the SMD of the spray increases. As the cone angle is reduced by increasing the size of the supply orifice in the upper plate, thereby causing the x/y ratio to become more negative, the SMD of the spray becomes larger. Therefore, as a general rule, as the cone angle increases, the size of the droplets in the spray decreases. This corresponds to the fluid being spread over a larger area.

It is also apparent that as the fuel pressure increases, the droplet size decreases. This is predictable since more energy is being forced into the liquid, creating higher velocities and therefore high viscous shear forces, which provides more energy to break up the liquid and enhance the atomization.

Under dynamic pulsing conditions similar to those actually encountered in the operation of an internal combustion engine, it can be observed that the SMD of the fluid droplets is smaller in all sections of the spray pulse. The distribution of the droplets within the pulse is also much more uniform when utilizing the geometries illustrated in FIGS. 2 and 3.

Therefore, the x/y ratio parameter is a key design parameter for the compound orifice plate nozzle. As long as the x/y ratio equals or exceeds 0.5, the exhaust spray will exhibit the minimum Sauter Mean Diameter, with minimal variation in cone angle and an adequate flow rate. If smaller cone angle is desired, a compound orifice plate having a 200 micron gap can deliver relatively small droplets in the 80 micron range with a 15°–23° cone angle.

While the supply and metering orifices have been illustrated and discussed as having generally square shapes in the preferred embodiments, similar results can be obtained using orifices having other shapes, such as rectangular, parallelogram, circular, elliptical, etc., without departing from the teachings of the present invention. The exact measurement of the x and y dimensions and the optimum x/y ratio may change slightly depending on the exact shapes and sizes of the orifices.

While particular embodiments of the invention have been illustrated and described, it will be obvious to those skilled in the art that various changes and modifications may be made without departing from the invention, and it is intended to cover in the appended claims all such modifications and equivalents of fall within the true spirit and scope of this invention.

What is claimed:

1. A method for improving the atomization quality from a fuel injector, comprising the steps of:

(a) inducing a first vortex turbulence in the fuel flowing past a first sharp edge protrusion of less than 90 degrees included angle in a supply orifice having a flow axis therein, (b) guiding the fuel through a turbulence cavity, (c) guiding the fuel out of the turbulence cavity through a first metering orifice, with the first metering orifice including a second sharp edge protrusion having an included angle of less than 90 degrees for generating a second vortex turbulence in the fuel, with the second sharp edge protrusion positioned downstream from the first sharp edge protrusion by a distance y measured generally parallel to the flow axis and by a distance x measured generally perpendicular to and radially outward from the flow axis, (d) maintaining the first vortex turbulence within the turbulence cavity at a position immediately adjacent to and upstream from the first metering orifice, and (e) minimizing the droplet size of the fuel exiting from the first metering orifice by maintaining the x/y ratio greater than 0.5.

2. The method as described in claim 1 wherein step (e) includes the step of maintaining the x/y ratio greater than 0.5 but less than 5 when the fuel is gasoline.

3. The method as described in claim 1 wherein step (e) includes the step of maintaining the x/y ratio less than 2 and greater than 0.5 when the fuel is gasoline.

4. The method as described in claim 1 wherein step (a) includes the substep of flowing the fuel through a supply orifice defined in a first flat plate, and wherein step (c) includes the substep of flowing the fuel through a first metering orifice defined in a second plate juxtaposed and coplanar with the first plate so as to define the turbulence cavity therebetween.

5. An apparatus for improving the atomization quality of fuel flowing from a fuel injector of the type used in the fuel system of an internal combustion engine, comprising:

a first body defining therein a supply orifice through which the fuel flows generally along a supply axis, said first body including first vortex turbulence means comprising a first acute edge protrusion, having an included angle of less than 90°, protruding into the fuel flow for generating a vortex turbulence in the fuel flowing adjacent thereto, a second body including therein at least one metering orifice through which the fuel flows out generally along an exhaust axis, with said second body coupled to said first body for defining therebetween a turbulence cavity having said supply orifice and said metering orifice opening thereinto, with said second body and said metering orifice further defining a second acute edge protrusion, having an included angle of less than 90 degrees, positioned downstream from said first acute edge protrusion by a distance y measured generally parallel to the supply axis and by a distance x measured generally transverse to and radially outwardly from the supply axis, said second acute edge protrusion positioned adjacent an upstream section of said metering orifice for inducing additional vortex turbulence in the fuel flowing out through said metering orifice, with said vortex turbulence being generated within said turbulence cavity in an area immediately adjacent to and upstream from said metering orifice, and wherein the ratio of x/y is greater than 0.5 for minimizing the Sauter Mean Diameter of the atomized fuel ejected from said metering orifice.

6. The apparatus as described in claim 5 wherein said first acute edge protrusion comprises a distended circumferential lip section of said first body defining a narrowed cross-section of said supply orifice therein.

7. The apparatus as described in claim 5 wherein said acute edge protrusion of said second body comprises a circumferential lip section of said metering orifice.

8. The apparatus as described in claim 5 wherein said first acute edge protrusion comprises an acute edge of a circumferential lip section of said first body which defines a generally rectangular neck section of said supply orifice therein, and wherein said second acute edge protrusion comprises an acute edge of a circumferential lip section of said second body which defines a generally rectangular neck section of said metering orifice therein.

9. The apparatus as described in claim 5 wherein said first body comprises a first silicon plate and said second body comprises a second silicon plate juxtaposed with and sealed to said first silicon plate.

10. The apparatus as described in claim 5 wherein said exhaust axis of said metering orifice is offset in a direction perpendicular to said supply axis such that said metering orifice is not coextensive at any point with said supply orifice.

11. A nozzle for improving the atomization quality of fluid flowing from a fluid injector, comprising:

a supply plate having a supply orifice through which the fluid flows, said supply plate further including a circumferential lip section having an acute angle of less than 90° for defining a narrowed section of said supply orifice for generating vortex turbulence proximately downstream in the fluid flowing adjacent thereto, a metering plate coupled to said supply plate for defining a turbulence cavity therebetween for containing therein said vortex turbulence, said metering plate including therein at least one metering orifice coupled to said turbulence cavity through which the fluid is expelled, said metering plate further including a circumferential lip section having an acute angle of less than 90° for defining a narrowed section of said metering orifice adjacent said turbulence cavity, with one edge of said circumferential lip section of said metering plate being displaced from an adjacent and corresponding edge of said circumferential lip section of said supply plate in the direction of fluid flow in said supply orifice by a distance y and offset in a direction generally perpendicular to and radially outwardly from the direction of fluid flow in said supply orifice by a distance x, with said x and y distances sized for positioning said vortex turbulence within said turbulence cavity in an area immediately adjacent to and upstream from said metering orifice, and with the ratio of x/y being greater than 0.5, thereby reducing the Sauter Mean Diameter of the atomized fluid exiting said metering orifice.

12. The nozzle as described in claim 11 wherein the fluid is gasoline, and wherein the ratio of x/y is greater than 0.5 and less than 5.0 for minimizing the Sauter Mean Diameter of the atomized gasoline exiting said metering orifice.

13. The nozzle as described in claim 11 wherein a first section of said metering plate adjacent said metering orifice entirely covers and diverts the axial flow of the fluid from said supply orifice through said metering orifice.

* * * * *